US010730292B2

(12) United States Patent
Kohda et al.

(10) Patent No.: US 10,730,292 B2
(45) Date of Patent: Aug. 4, 2020

(54) LIQUID DISCHARGE HEAD, LIQUID DISCHARGE DEVICE, AND LIQUID DISCHARGE APPARATUS

(71) Applicant: RICOH COMPANY, LTD., Tokyo (JP)

(72) Inventors: Tomohiko Kohda, Ibaraki (JP); Satoru Tobita, Ibaraki (JP); Ryo Kasahara, Kanagawa (JP); Ryohta Matsufuji, Kanagawa (JP); Norimasa Sohgawa, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/009,453

(22) Filed: Jun. 15, 2018

(65) Prior Publication Data

US 2018/0290446 A1 Oct. 11, 2018

Related U.S. Application Data

(62) Division of application No. 15/340,275, filed on Nov. 1, 2016, now Pat. No. 10,022,963.

(30) Foreign Application Priority Data

Nov. 6, 2015 (JP) ..... 2015-218392
Mar. 9, 2016 (JP) ..... 2016-046141
Jun. 27, 2016 (JP) ..... 2016-126254

(51) Int. Cl.
*B41J 2/055* (2006.01)
*B41J 2/14* (2006.01)
*B41J 2/175* (2006.01)

(52) U.S. Cl.
CPC ..... *B41J 2/055* (2013.01); *B41J 2/1433* (2013.01); *B41J 2/14233* (2013.01);
(Continued)

(58) Field of Classification Search
CPC ..... B41J 2/055; B41J 2/14201; B41J 2/1433; B41J 2002/14419
See application file for complete search history.

(56) References Cited

U.S. PATENT DOCUMENTS

2009/0102907 A1 4/2009 Yamanaka et al.
2010/0328400 A1 12/2010 Koda et al.
(Continued)

FOREIGN PATENT DOCUMENTS

JP 9-141856 6/1997
JP 2002-137386 5/2002
(Continued)

OTHER PUBLICATIONS

Office Action dated Mar. 10, 2020 in Japanese Patent Application No. 2016-126254, 4 pages.

*Primary Examiner* — Alessandro V Amari
*Assistant Examiner* — Kendrick X Liu
(74) *Attorney, Agent, or Firm* — Oblon, McClelland, Maier & Neustadt, L.L.P.

(57) ABSTRACT

A liquid discharge head includes a plurality of nozzles, a plurality of individual liquid chambers, a common liquid chamber, a deformable damper, and a damper chamber. The plurality of nozzles is arrayed in a nozzle array direction, to discharge liquid. The plurality of individual liquid chambers is communicated with the plurality of nozzles. The common liquid chamber supplies liquid to the plurality of individual liquid chambers. The deformable damper constitutes part of a wall face of the common liquid chamber. The damper chamber is disposed along the nozzle array direction with the damper interposed between the damper chamber and the common liquid chamber. The damper chamber extends to an outer area in the nozzle array direction than an individual
(Continued)

liquid chamber of the plurality of individual liquid chambers at each end in the nozzle array direction.

10 Claims, 17 Drawing Sheets

(52) U.S. Cl.
CPC ..... *B41J 2/14274* (2013.01); *B41J 2/175* (2013.01); *B41J 2002/14306* (2013.01); *B41J 2002/14419* (2013.01); *B41J 2202/20* (2013.01)

(56) References Cited

U.S. PATENT DOCUMENTS

| | | | |
|---|---|---|---|
| 2010/0328409 | A1 | 12/2010 | Matsufuji et al. |
| 2011/0057992 | A1 | 3/2011 | Tobita et al. |
| 2012/0236052 | A1 | 9/2012 | Tobita et al. |
| 2013/0038651 | A1 | 2/2013 | Satou et al. |
| 2013/0070010 | A1 | 3/2013 | Tobita et al. |
| 2013/0242001 | A1 | 9/2013 | Kuwata et al. |
| 2013/0242012 | A1 | 9/2013 | Hayashi et al. |
| 2013/0257993 | A1* | 10/2013 | Ono ..... B41J 2/055 347/54 |
| 2014/0009544 | A1 | 1/2014 | Koda |
| 2014/0160193 | A1 | 6/2014 | Iwata et al. |
| 2015/0077469 | A1 | 3/2015 | Kohda et al. |
| 2016/0082728 | A1 | 3/2016 | Kohda et al. |
| 2016/0096369 | A1 | 4/2016 | Shimizu et al. |

FOREIGN PATENT DOCUMENTS

| | | | |
|---|---|---|---|
| JP | 2008-230202 | A | 10/2008 |
| JP | 2009-051145 | | 3/2009 |
| JP | 2010-188547 | A | 9/2010 |
| JP | 2011-034559 | | 2/2011 |
| JP | 2011-182020 | | 9/2011 |
| JP | 2013-203062 | A | 10/2013 |
| JP | 2015-186901 | | 10/2015 |

* cited by examiner

LIQUID DISCHARGE HEAD, LIQUID DISCHARGE DEVICE, AND LIQUID DISCHARGE APPARATUS

CROSS-REFERENCE TO RELATED APPLICATIONS

This patent application is a divisional of U.S. application Ser. No. 15/340,275 filed Nov. 1, 2016 which is based on and claims priority pursuant to 35 U.S.C. § 119(a) to Japanese Patent Application Nos. 2015-218392 filed on Nov. 6, 2015, 2016-046141 filed on Mar. 9, 2016, and 2016-126254 filed on Jun. 27, 2016, in the Japanese Patent Office, the entire disclosure of each of which is hereby incorporated by reference herein.

BACKGROUND

Technical Field

Aspects of the present disclosure relate to a liquid discharge head, a liquid discharge device, and a liquid discharge apparatus.

Related Art

In a liquid discharge head, pressure waves caused by liquid discharge may propagate to a common liquid chamber and cause failures, such as, mutual interference, discharge failure, or liquid leakage.

To reduce or prevent such failures, for example, a deformable damper is disposed at a portion of a wall face of the common liquid chamber and a plurality of damper chambers is disposed at a side opposite the common liquid chamber via the damper.

SUMMARY

In an aspect of the present disclosure, there is provided a liquid discharge head that includes a plurality of nozzles, a plurality of individual liquid chambers, a common liquid chamber, a deformable damper, and a damper chamber. The plurality of nozzles is arrayed in a nozzle array direction, to discharge liquid. The plurality of individual liquid chambers is communicated with the plurality of nozzles. The common liquid chamber supplies liquid to the plurality of individual liquid chambers. The deformable damper constitutes part of a wall face of the common liquid chamber. The damper chamber is disposed along the nozzle array direction with the damper interposed between the damper chamber and the common liquid chamber. The damper chamber extends to an outer area in the nozzle array direction than an individual liquid chamber of the plurality of individual liquid chambers at each end in the nozzle array direction.

In another aspect of the present disclosure, there is provided a liquid discharge head that includes at least two nozzle rows, a plurality of individual liquid chambers, at least two common liquid chambers, at least two dampers, and at least two damper chambers. In the at least two nozzle rows, a plurality of nozzles to discharge liquid is arrayed in a nozzle array direction. The plurality of individual liquid chambers is communicated with the at least two nozzle rows. The at least two common liquid chambers correspond to the at least two nozzle rows and supply liquid to the plurality of individual liquid chambers. The at least two dampers correspond to the at least two nozzle rows. Each of the at least two dampers constitutes a wall face of each of the at least two common liquid chambers along the nozzle array direction. The at least two damper chambers correspond to the at least two nozzle rows. Each of the at least two damper chambers is disposed with a corresponding one of the at least two dampers interposed between each of the at least two damper chambers and a corresponding one of the at least two common liquid chambers. The at least two damper chambers include a plurality of columns to support the at least two dampers. At least one column of the plurality of columns in one damper chamber of the at least two damper chambers and at least one column of the plurality of columns in another damper chamber of the at least two damper chambers are disposed at different positions in the nozzle array direction.

In still another aspect of the present disclosure, there is provided a liquid discharge head that include two nozzle rows, a plurality of individual liquid chambers, two common liquid chambers, two dampers, and two damper chambers. In the two nozzle rows, a plurality of nozzles to discharge liquid is arrayed in a nozzle array direction. The plurality of individual liquid chambers is communicated with the two nozzle rows. The two common liquid chamber's correspond to the two nozzle rows and supply liquid to the plurality of individual liquid chambers. The two dampers correspond to the two nozzle rows. Each of the dampers constitutes a wall face of each of the two common liquid chambers along the nozzle array direction. The two damper chambers correspond to the two nozzle rows. Each of the two damper chambers is disposed with a corresponding one of the two dampers interposed between each of the two damper chambers and a corresponding one of the two common liquid chambers. The two damper chambers include a plurality of columns to support the two dampers. An end wall face of one damper chamber of the two damper chambers in the nozzle array direction and an end wall face of another damper chamber of the two damper chambers in the nozzle array direction are disposed at different positions in the nozzle array direction.

In still yet another aspect of the present disclosure, there is provided a liquid discharge device that includes the liquid discharge head according to any of the above-described aspects.

In still yet another aspect of the present disclosure, there is provided a liquid discharge apparatus that includes the liquid discharge device.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
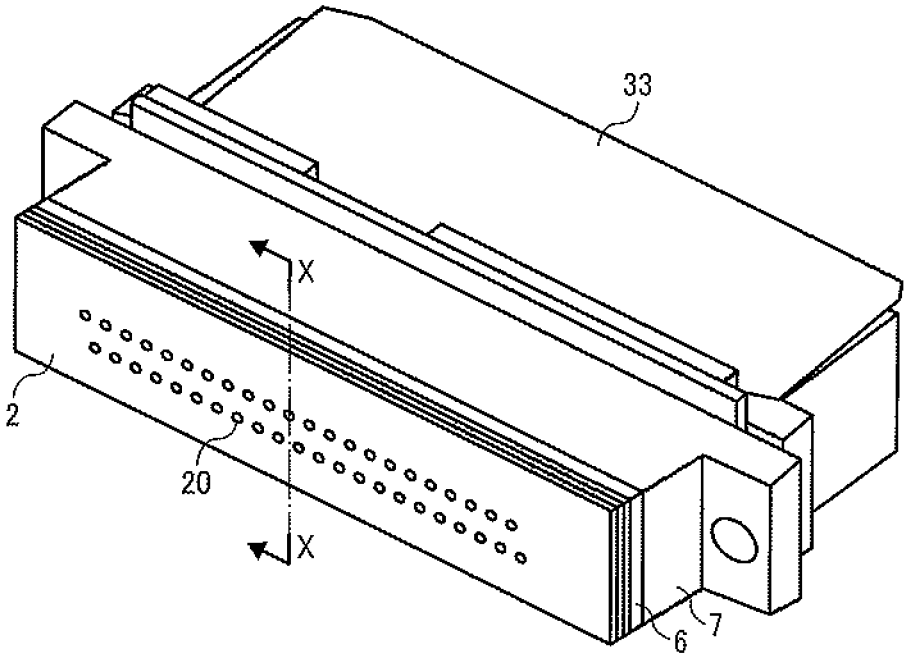
FIG. 1 is an outer perspective view of a liquid discharge head according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Figure 2:
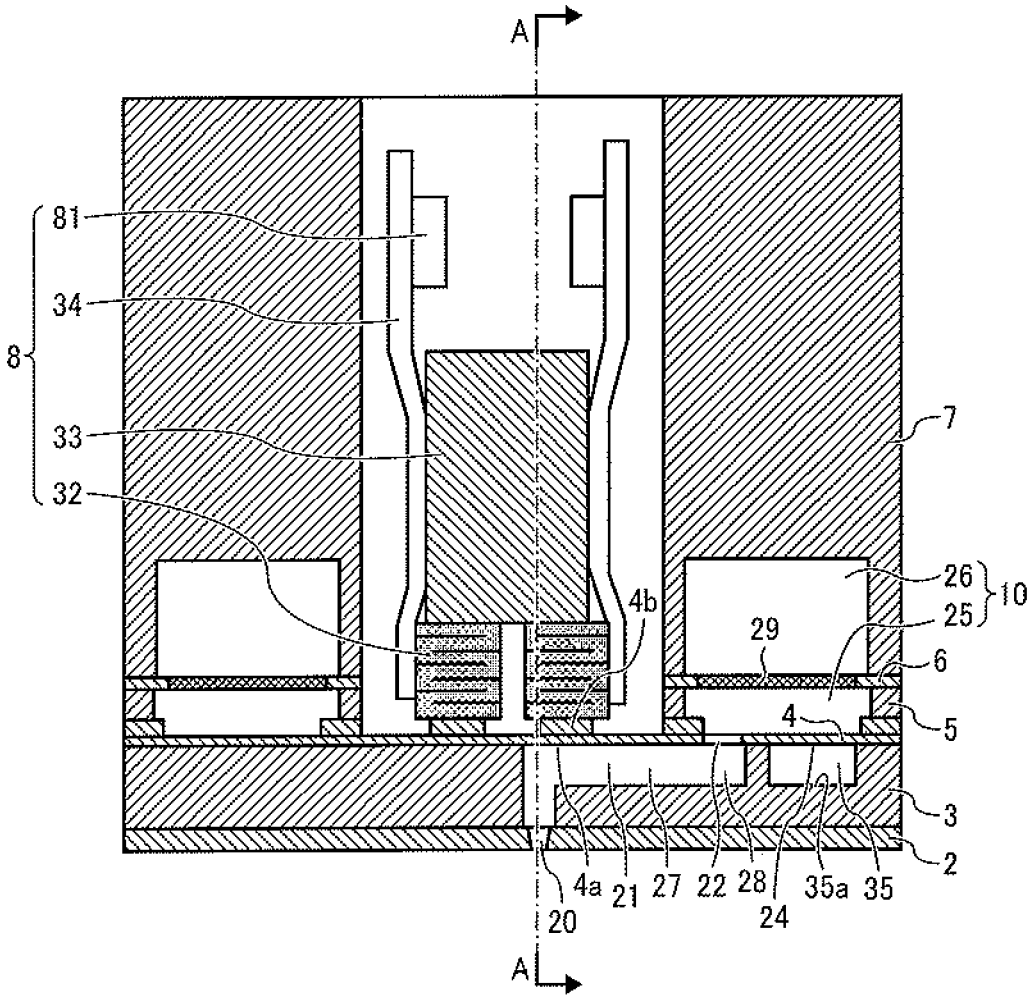
FIG. 2 is a cross-sectional view of the liquid discharge head cut along line X-X of FIG. 1 in a direction perpendicular to a nozzle array direction in which nozzles are arrayed in row.
Figure 3:
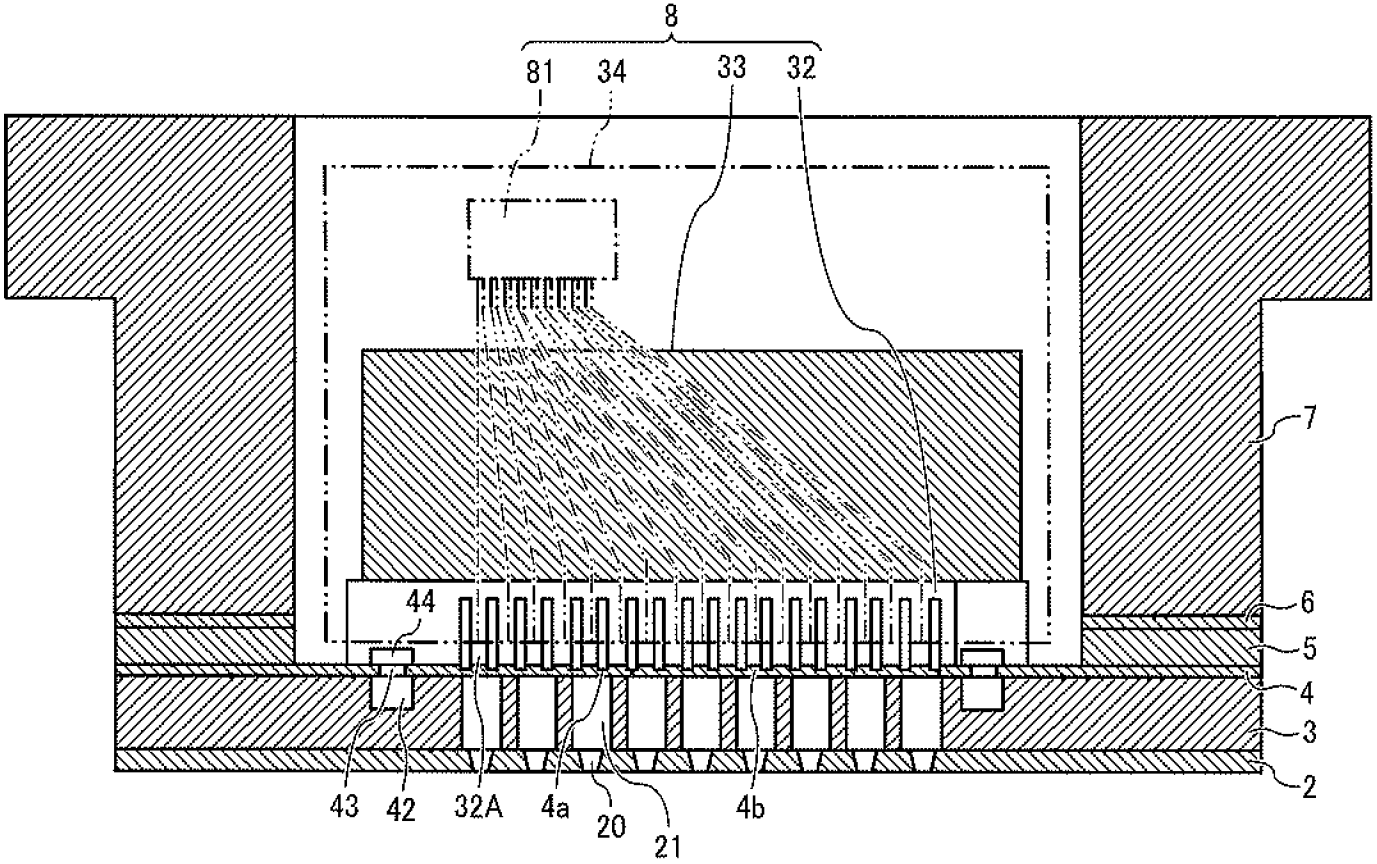
FIG. 3 is a cross-sectional view of the liquid discharge head cut along line A-A of FIG. 2.

Hereinafter, embodiments of the present disclosure are described with reference to the attached drawings. A liquid discharge head according to an embodiment of the present disclosure is described with reference to FIGS. 1 to 3. FIG. 1 is an outer perspective view of the liquid discharge head according to an embodiment of the present disclosure. FIG. 2 is a cross-sectional view of the liquid discharge head cut along line X-X of FIG. 1 in a direction perpendicular to a nozzle array direction in which nozzles are arrayed in row. FIG. 3 is a cross-sectional view of the liquid discharge head cut along line A-A of FIG. 2.

A liquid discharge head 404 according to the present embodiment includes a nozzle plate 1, a channel plate 3 being a channel member, a diaphragm member 4 also serving as a wall member, a second common-liquid-chamber member 5, a filter member 6, and a first common-liquid-chamber member 7 that are laminated one on another and bonded together.

In the nozzle plate 2, a plurality of nozzles 20 to discharge liquid is arrayed in a staggered manner in two rows. The nozzle plate 2 is made of, for example, stainless steel (in the present embodiment, SUS 316) and the nozzles 20 are formed in the nozzle plate 2 by pressing process.

The channel plate 3 forms individual liquid chambers 21 being individual liquid chambers communicated with the nozzles 20, fluid restrictors 27 communicated with the individual liquid chambers 21, and liquid inlets 28 communicated with the fluid restrictors 27. The channel plate 3 is formed by pressing, for example, stainless steel (in the present embodiment, SUS 316), and deformation and burrs caused by the pressing are post-processed by polishing both faces of the pressed stainless steel so that the pressed stainless steel be substantially flat.

The diaphragm member 4 forms a wall of each of the individual liquid chambers 21 as a displaceable vibration area 4*a*. The diaphragm member 4 includes liquid supply channels 22 opened to under-filter common liquid chambers 25 and communicating the under-filter common liquid chambers 25 and the liquid inlets 28 of the respective individual liquid chambers 21. The diaphragm member 4 is formed by Ni electroforming.

On a side of the diaphragm member 4 opposite the individual liquid chambers 21, the second common-liquid-chamber member 5, the filter member 6, and the first common-liquid-chamber member 7 also serving as a frame of the liquid discharge head 404 are laminated in turn and bonded together with adhesive.

The first common-liquid-chamber member 7 and the second common-liquid-chamber member 5 constitute common-liquid-chamber substrates forming common liquid chambers 10 communicated with the individual liquid chambers 21. Each common liquid chamber 10 is formed with an over-filter common liquid chamber 26 upstream from the filter member 6 and the under-filter common liquid chamber 25 downstream from the filter member 6.

The filter member 6 includes filter portions 29 having filter holes to collect foreign substances from liquid flowing from the over-filter common liquid chambers 26 to the under-filter common liquid chambers 25.

The first common-liquid-chamber member 7 constitutes the over-filter common liquid chambers 26 and includes liquid supply ports to introduce liquid supplied from the outside. The liquid supply ports are disposed at both ends in a longitudinal direction of the over-filter common liquid chamber 26.

A piezoelectric actuator 8 is disposed at a side of the vibration areas 4*a* of the diaphragm member 4 opposite the individual liquid chambers 21.

In the piezoelectric actuator 8, two piezoelectric members 32 are bonded to a base member 33. The piezoelectric members 32 include piezoelectric elements (piezoelectric pillars) 32A that are arranged in two rows corresponding to the two nozzle rows. In each row, the piezoelectric elements 32A are arranged at a pitch of half of the pitch of nozzles. The piezoelectric elements 32A are bonded to convex portions 4*b* at the vibration areas 4*a* of the diaphragm member 4. Drive signals are supplied from drive integrated circuits (IC) 81, which are mounted on flexible wiring members 34, to the piezoelectric elements 32A via the flexible wiring members 34.

The channel plate 3 and a common-liquid-chamber member (the second common-liquid-chamber member 5) are laminated via the diaphragm member 4.

A portion of the diaphragm member 4 constituting a wall of each under-filter common liquid chamber 25 is a deformable area (damper) 24. The channel plate 3 includes damper chambers 35 opposing the under-filter common liquid chambers 25.

The damper chambers 35 are opened to the atmospheric air through air release channels 42 of the channel plate 3, air release holes 43 of the diaphragm member 4 and air release channels 44 of the piezoelectric members 32.

For the liquid discharge head 404, the vibration areas 4*a* of the diaphragm member 4 are displaced by driving of the piezoelectric actuator 8 to pressurize liquid in the individual liquid chambers 21, thus ejecting droplets from the nozzles 20.

Figure 4:
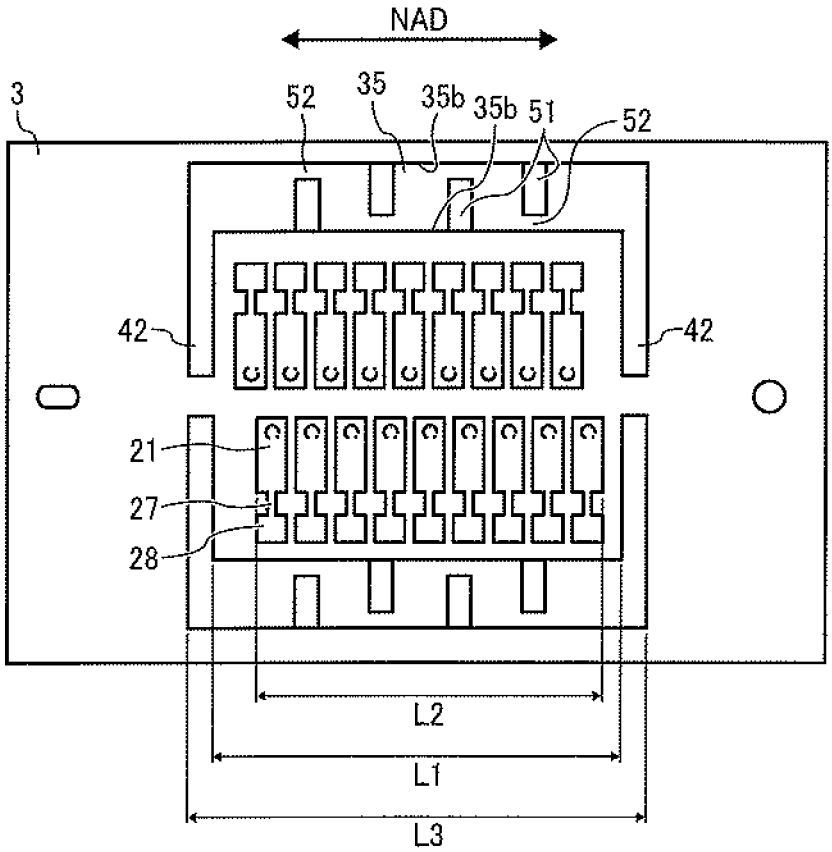
FIG. 4 is a plan view of a channel plate in a first embodiment of the present disclosure, seen from a side at which a diaphragm member is disposed.
Figure 5:
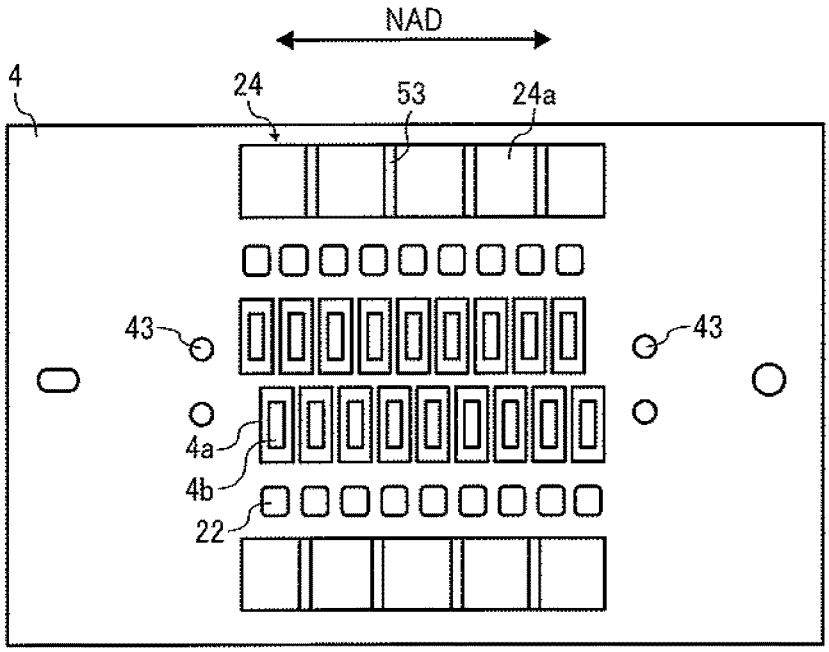
FIG. 5 is a plan view of the diaphragm member in the first embodiment, seen from a side at which a second common-liquid-chamber member is disposed.

Next, a first embodiment of this disclosure is described with reference to FIGS. 4 and 5. FIG. 4 is a plan view of the channel plate seen from a side at which the diaphragm member is disposed. FIG. 5 is a plan view of the diaphragm member seen from a side at which the second common-liquid-chamber member is disposed.

At an end of the channel plate 3 in the direction perpendicular to the nozzle array direction NAD, the damper chambers 35 of recessed shapes corresponding to the dampers 24 of the diaphragm member 4 are disposed along the nozzle array direction. The damper chambers 35 are opposed to the under-filter common liquid chambers 25 via the dampers 24.

At both ends of each damper chamber 35 in the nozzle array direction, the air release channels 42 are disposed to open (communicate) the damper chamber 35 to the atmospheric air. As described above, the air release channels 42 are communicated with the atmospheric air through the air release channels 44 of the piezoelectric members 32.

Wall portions (ribs) 51 as columns are disposed at a recessed bottom 35*a* of the damper chamber 35. The wall portions 51 are partially disposed between wall faces 35*b* of the damper chamber 35 (with clearance as a passage 52) to form the passage 52 through which internal air is communicated with the atmospheric air. Note that, in the present embodiment, the wall portions 51 are integrally molded with the wall faces 35*b* although the wall portions 51 are distinguished from the wall faces 35*b* in the plan view illustrated in FIG. 4.

The plurality of wall portions 51 is disposed in the nozzle array direction NAD. Between adjacent ones of the wall portions 51, areas of the passage 52 are disposed at different positions in the direction perpendicular to the nozzle array direction NAD.

Each of the dampers 24 includes a plurality of ribs 53 arranged in the nozzle array direction to divide a plurality of damper areas 24*a*. One damper area 24*a* corresponds to two or more individual liquid chambers 21.

Note that, in the present embodiment, the ribs 53 are integrally molded with the damper 24. In some embodiments, a member including the ribs 53 may be attached to the damper 24.

The damper chamber 35 extends to an outer area in the nozzle array direction NAD than one of the individual liquid chambers 21 at each end in the nozzle array direction NAD.

In other words, the shortest width (length) L1 of the damper chamber 35 in the nozzle array direction NAD is longer than the longest width L2 between both ends of a row of the individual liquid chambers 21 arranged in the nozzle array direction NAD (L1>L2). All of the individual liquid chambers 21 are disposed within the shortest width L1 of the damper chamber 35 in the nozzle array direction NAD.

As described above, the damper chamber 35 extends to an outer area in the nozzle array direction NAD than one of the individual liquid chambers 21 at each end in the nozzle array direction NAD. Such a configuration can reduce variances in rigidity in the nozzle array direction, thus reducing variances in discharge properties in the nozzle array direction.

In other words, when the damper chamber 35 being the recessed portion is disposed along the nozzle array direction in the channel plate 3, a less-rigid area is formed by the damper chamber 35 at a center portion of the liquid discharge head in the nozzle array direction. By contrast, outer areas than both ends of the damper chamber 35 in the nozzle array direction are more rigid.

Accordingly, even if the same level of pressure is applied by the piezoelectric actuator 8, the less-rigid area at the center portion of the liquid discharge head in the nozzle array direction more absorbs pressure by deformation. If nozzles are disposed at the outer areas than both ends of the damper chamber 35 in the nozzle array direction, the discharge speed of liquid discharged from nozzles at the less-rigid area of the center portion would be lower than the discharge speed of liquid discharged from the nozzles at the outer areas than both ends of the damper chamber 35.

Hence, in the present embodiment, each of the damper chambers 35 is disposed including an area in which the plurality of individual liquid chambers 21 is disposed in the nozzle array direction, thus reducing variances in rigidity.

With such a configuration, when individual liquid chambers 21 at both ends in the nozzle array direction are pressurized, pressure is absorbed similarly with individual liquid chambers 21 at the center portion in the nozzle array direction. Accordingly, the discharge speed of liquid discharged from nozzles at the area of the center portion are substantially the same as the discharge speed of liquid discharged from nozzles at both ends in the nozzle array direction.

Figure 6:
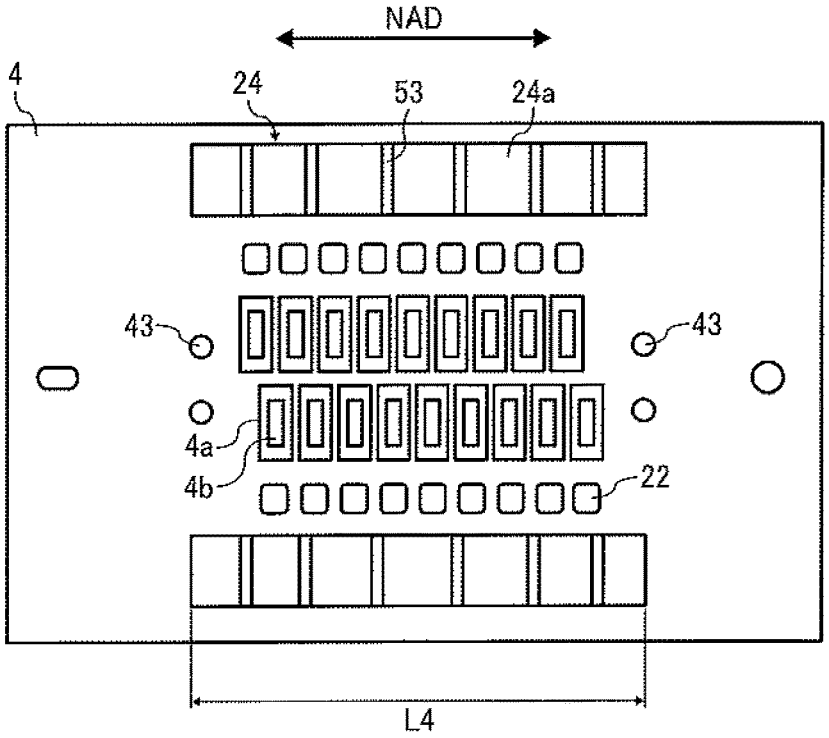
FIG. 6 is a plan view of the diaphragm member in a second embodiment of the present disclosure, seen from the side at which the second common-liquid-chamber member is disposed.

Next, a second embodiment of the present disclosure is described with reference to FIGS. 4 and 6. FIG. 6 is a plan view of the diaphragm member in the second embodiment, seen from the side at which the second common-liquid-chamber member is disposed.

In the present embodiment, the width L4 of the damper 24 in the nozzle array direction is not less than the width L1 of the damper chamber 35 and is the same as the width L3 illustrated in FIG. 4.

Such a configuration can more reduce variances in rigidity.

Figure 7:
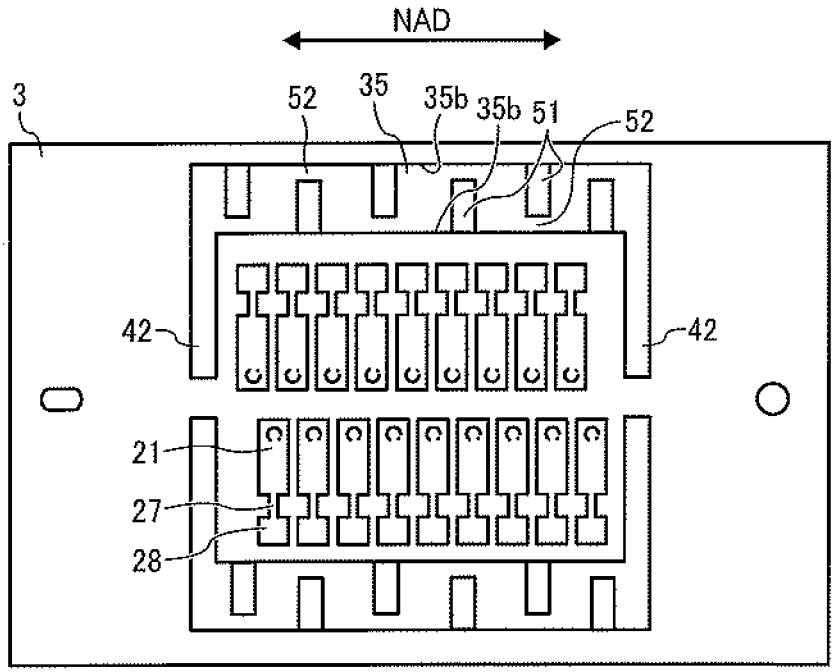
FIG. 7 is a plan view of the channel plate in a third embodiment of the present disclosure, seen from the side at which the diaphragm member is disposed.
Figure 8:
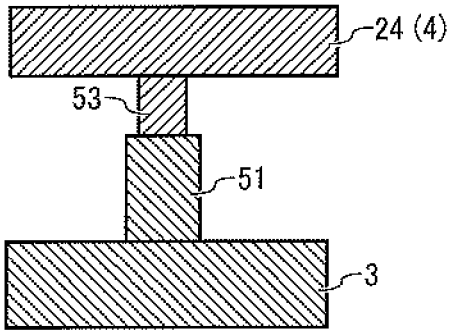
FIG. 8 is a cross-sectional view of a portion of the channel plate in a third embodiment.

Next, a third embodiment of the present disclosure is described with reference to FIGS. 7 and 8. FIG. 7 is a plan view of the third embodiment. FIG. 8 is a cross-sectional view of a portion of the third embodiment.

In the present embodiment, the ribs 53 of the damper 24 and the wall portions 51 of the damper chamber 35 are disposed at positions opposed each other.

Such a configuration can reliably press the channel plate 3 and the diaphragm member 4 at areas of the damper chambers 35 to bond the channel plate 3 and the diaphragm member 4, thus securing the bonding strength of the diaphragm member 4 and the channel plate 3. Accordingly, a sufficient rigidity of the channel plate 3 can be obtained.

Figure 9:
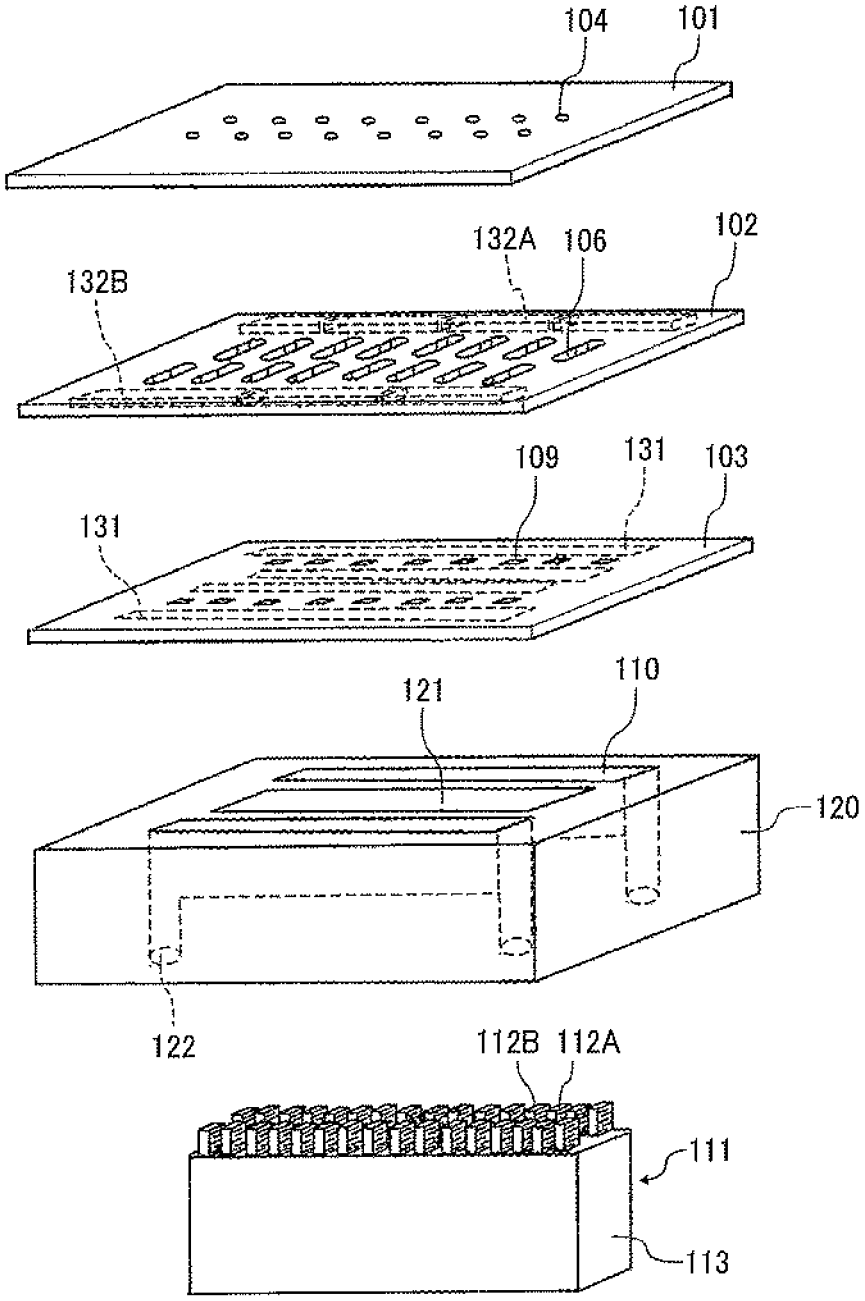
FIG. 9 is an exploded perspective view of the liquid discharge head according to a fourth embodiment of the present disclosure.
Figure 10:
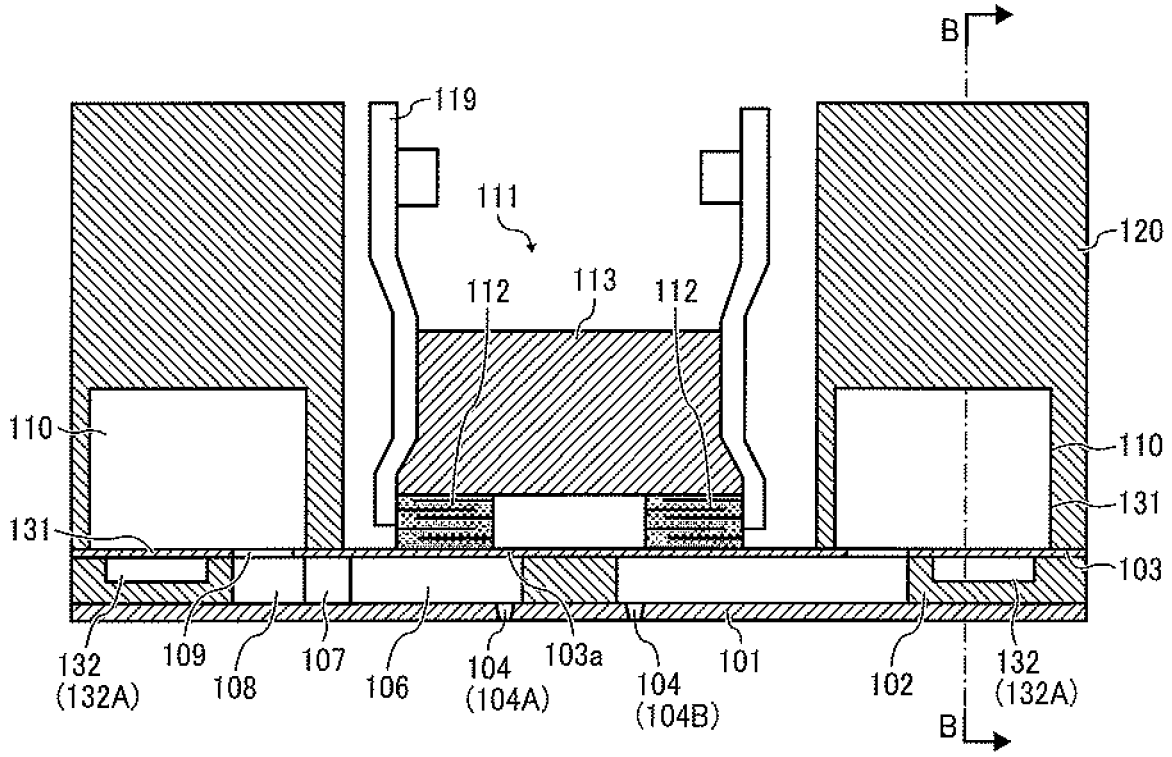
FIG. 10 is a cross-sectional view of the liquid discharge head of FIG. 9 cut along a line corresponding to line A-A of FIG. 2.
Figure 11:
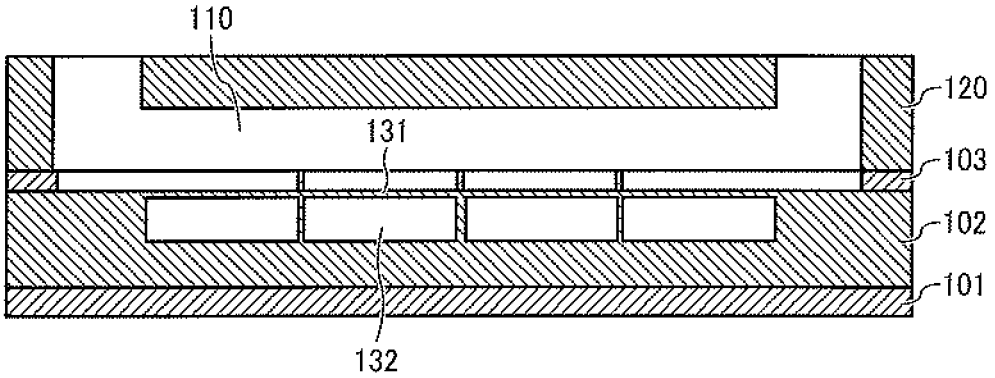
FIG. 11 is a cross-sectional view of the liquid discharge head cut along line B-B of FIG. 10.
Figure 12A:
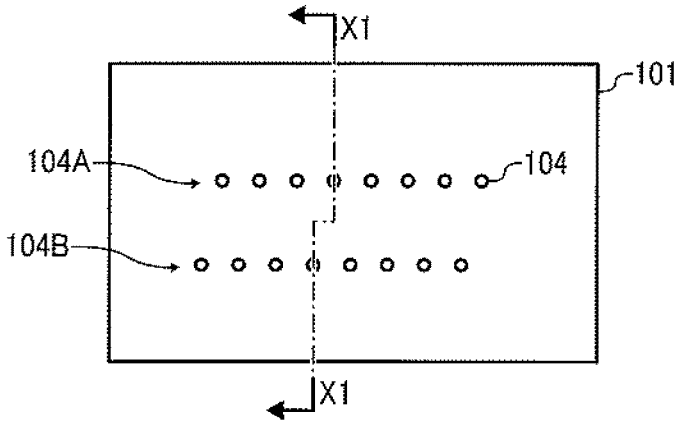
FIGS. 12A through 12E are plan views of components of the liquid discharge head of FIG. 9 seen from a side at which nozzles are disposed.
Figure 12B:
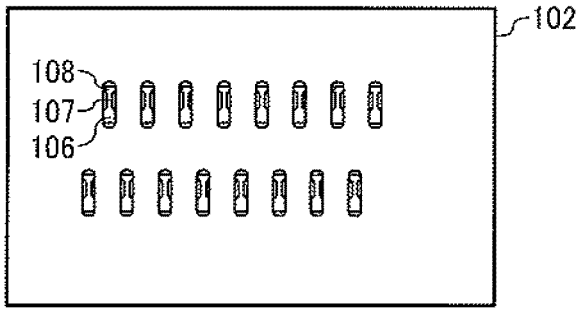
Figure 12C:
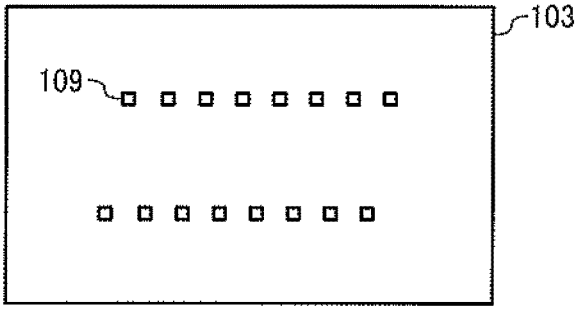
Figure 12D:
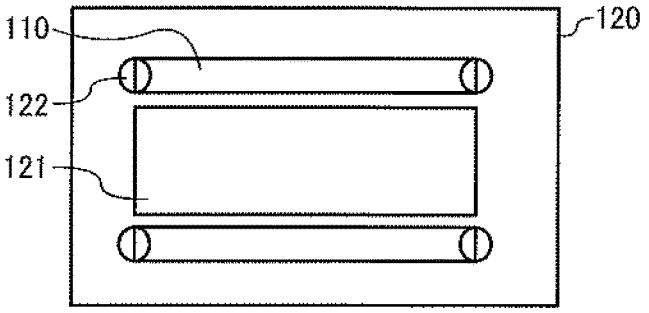
Figure 12E:
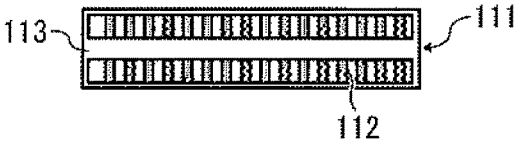
Figure 13A:
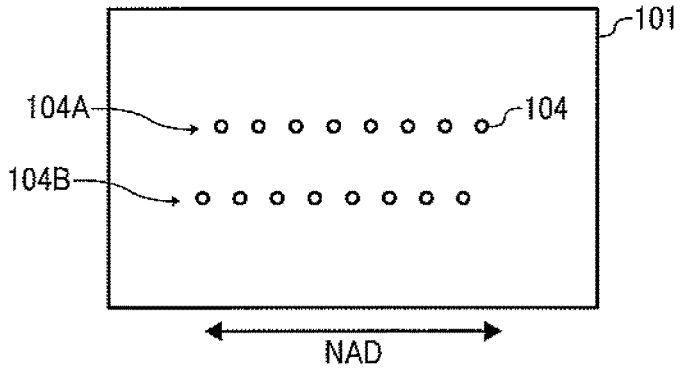
FIGS. 13A through 13E are plan views of the components of the liquid discharge head of FIG. 9 from a side at which a piezoelectric actuator is disposed.
Figure 13B:
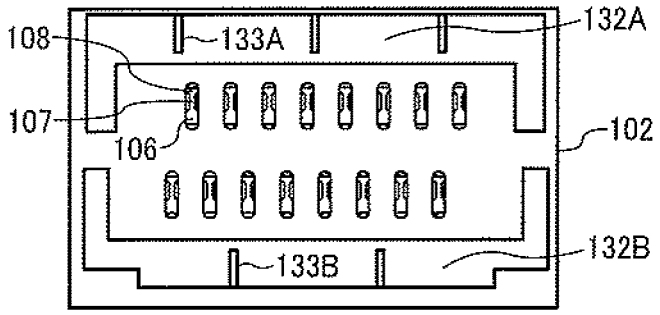
Figure 13C:
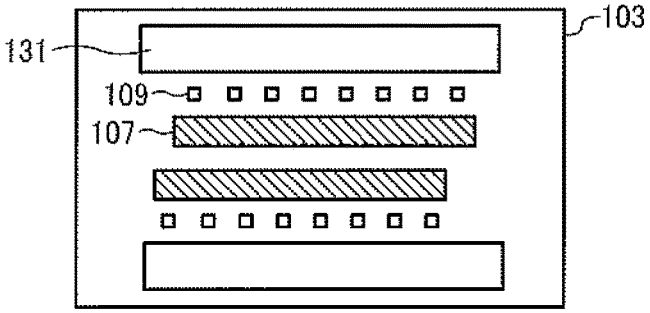
Figure 13D:
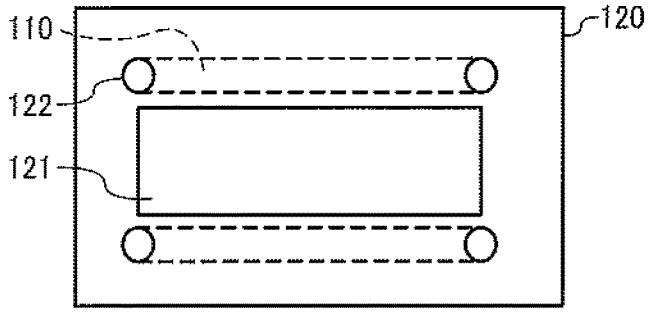
Figure 13E:
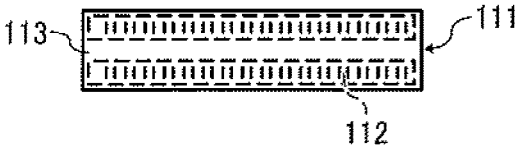

Next, the liquid discharge head according to a fourth embodiment of the present disclosure is described with reference to FIGS. 9 to 11. FIG. 9 is an exploded perspective view of the liquid discharge head according to the fourth embodiment. FIG. 10 is a cross-sectional view of the liquid discharge head of FIG. 9 cut along a line corresponding to line A-A of FIG. 2. FIG. 11 is a cross-sectional view of the liquid discharge head cut along line B-B of FIG. 10. FIGS. 12A through 12E are plan views of components of the liquid discharge head of FIG. 9 seen from a side at which nozzles are disposed. FIGS. 13A through 13E are plan views of the components of the liquid discharge head of FIG. 9 from a side at which the piezoelectric actuator is disposed.

The liquid discharge bead 404 according to the fourth embodiment includes the nozzle pate 101, the channel plate 102, the diaphragm member 103, a piezoelectric actuator 111, and a common-liquid-chamber member 120 also serving as a frame member.

The nozzle pate 101 includes two nozzle rows 104A and 104B, in each of which a plurality of nozzles 104 is arranged to discharge droplets.

The channel plate 102 forms individual liquid chambers 106 communicated with the nozzles 104, fluid restrictors 107 being liquid supply channels to supply liquid to the individual liquid chambers 106, and liquid introduction portions 108 upstream from the fluid restrictors 107 in a direction of flow of liquid. The channel plate 102 is made of, for example, stainless steel (e.g., SUS 304) and formed by pressing process.

The diaphragm member 103 forms a wall of each of the individual liquid chambers 106 as a displaceable vibration area 103*a*, The diaphragm member 103 includes openings 109 that are open to the common liquid chambers 110 and communicate the common liquid chambers 110 with the liquid introduction portions 108 at the entry side of the respective individual liquid chamber 106. The diaphragm member 103 has a two-layer structure and is formed by Ni electroforming.

The common-liquid-chamber members 120 are bonded to a side of the diaphragm member 103 opposite the individual liquid chambers 106.

A piezoelectric actuator 111 is disposed at a side of the vibration areas 103*a* of the diaphragm member 103 opposite the individual liquid chambers 106.

In the piezoelectric actuator 111, two pillar-shaped piezoelectric elements 112 are bonded to a base member 113. The piezoelectric elements 112 are arranged in two rows corresponding to two nozzle rows of the nozzles 104. In each row, the piezoelectric elements 112 are arranged at a pitch of half of the pitch of the nozzles 104. The piezoelectric elements 112 are bonded to convex portions of the vibration areas 103*a* of the diaphragm member 103. Drive signals are applied to the piezoelectric elements 112 via flexible wiring members 119.

The piezoelectric actuator 111 is inserted into and disposed in an actuator insertion hole 121 of the common-liquid-chamber member 120.

The common-liquid-chamber member 120 includes the common liquid chambers 110 to supply liquid to the individual liquid chambers 106. The common liquid chambers 110 have liquid supply ports 122 through which liquid is supplied from the outside to the common liquid chambers 110.

In the liquid discharge head 404 thus configured, for example, when the voltage applied to the piezoelectric element 112 is reduced from a reference potential, the piezoelectric element 112 contracts and the vibration area 103*a* of the diaphragm member 103 deforms. Accordingly, the volume of the individual liquid chamber 106 increases, thus causing liquid to flow into the individual liquid chamber 106. When the voltage applied to the piezoelectric element 112 is raised, the piezoelectric element 112 extends in a direction of lamination. Accordingly, the vibration area 103*a* deforms in a direction toward the nozzle 104 to pressurize liquid in the individual liquid chamber 106, thus discharging liquid from the nozzle 104.

When the voltage applied to the piezoelectric element 112 is returned to the reference potential, the vibration area 103*a* is returned to the initial position. Accordingly, the individual liquid chamber 106 expands to generate a negative pressure, thus replenishing liquid from the common liquid chamber 110 into the individual liquid chamber 106. The liquid discharge head 404 shifts to an operation for the next droplet discharge.

Note that the method of driving the liquid discharge head 404 is not limited to the above-described example (pull-push discharge). For example, pull discharge or push discharge may be performed in accordance with the way to apply a drive waveform.

Figure 14:
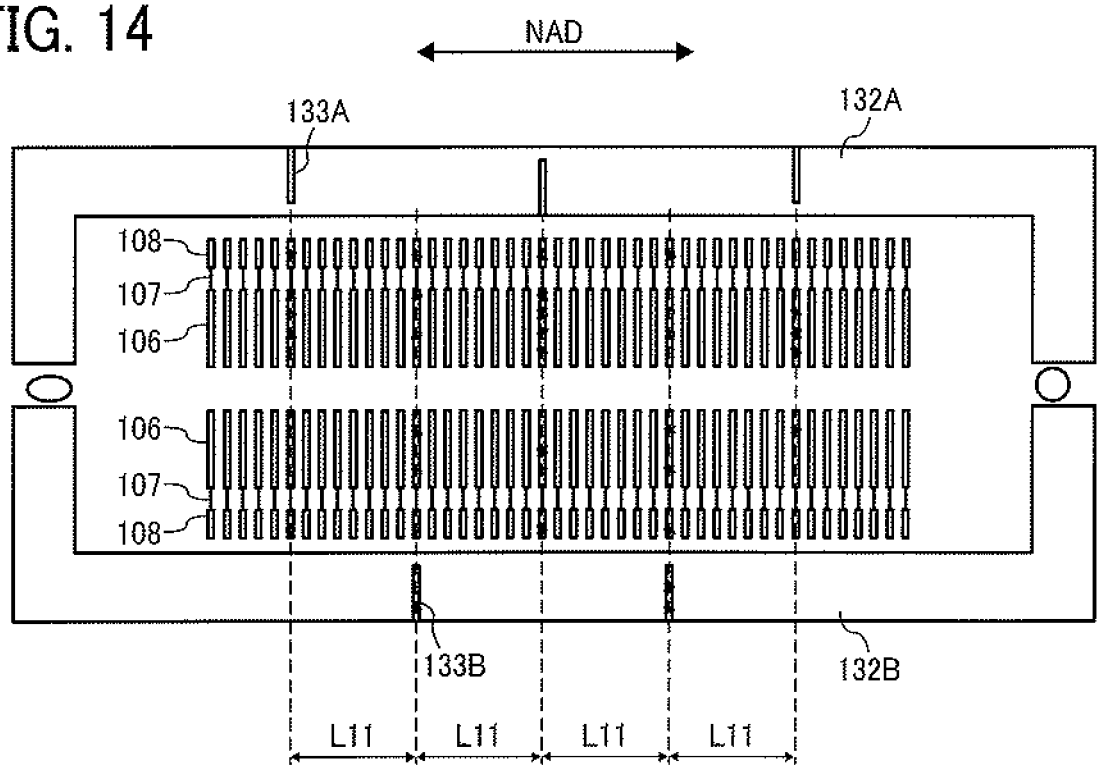
FIG. 14 is a plan view of damper chambers of the channel plate in the fourth embodiment, seen from the side at which the diaphragm member is disposed.

Next, the configuration of dampers in the fourth embodiment is described with reference to FIG. 14. FIG. 14 is a plan view of damper chambers of the channel plate in the fourth embodiment, seen from a side at which the diaphragm member is disposed.

In the present embodiment, the liquid discharge head 404 includes the two common liquid chambers 110, two dampers 131, and two damper chambers 132 corresponding to the two nozzle rows 104A and 104B. The common liquid chambers 110 supply liquid to the individual liquid chambers 106 communicated with the nozzles 104. The dampers 131 form walls of the common liquid chambers 110 along the nozzle array direction NAD. The damper chambers 132 are disposed at a side opposite the common liquid chamber 110 via the dampers 131.

The dampers 131 are formed with a layer of a portion of the diaphragm member 103. The damper chambers 132 are formed with recessed portions of the channel plate 102. The damper chambers 132 includes a damper chamber 132A at a side of the nozzle row 104A and a damper chamber 132B at a side of the nozzle row 104B.

The damper chamber 132A and the damper chamber 132B (referred to as the damper chambers 132 unless distinguished) include columns 133A and columns 133B (also referred to as the columns 133 unless distinguished), respectively. The columns 133A and the columns 133B are bonded to the dampers 131.

The columns 133A of the damper chamber 132A are disposed at different positions from the columns 133B of the damper chamber 132B in the nozzle array direction NAD. In the present embodiment, the columns 133A of the damper chamber 132A and the columns 133B of the damper chamber 132B are arranged in a staggered manner in the nozzle array direction NAD.

When the liquid discharge head 404 has the plurality of nozzle rows 104A and 104B, such a configuration can disperse nozzles 104 having different discharge properties in the nozzle array direction NAD.

In other words, a portion with the columns 133 and a portion without the columns 133 differ from each other in the function as the damper. Pressure waves propagated from the common liquid chambers 110 differ between individual liquid chambers 106 corresponding to the columns 133 (at the same positions as or adjacent positions to the columns 133 in the nozzle array direction NAD) and individual liquid chambers 106 not corresponding to the columns 133. Accordingly, the discharge properties, in particular, the discharge speed are different between the nozzles 104 and the landing positions of droplets may deviate from the target landing positions.

Here, if the columns 133A of the damper chamber 132A and the columns 133B of the damper chamber 132B corresponding to the nozzle row 104A and the nozzle row 104B, respectively, are identical in the nozzle array direction NAD, nozzles 104 on which the columns 133 are disposed would concentrate when droplets are discharged from one nozzle row of the nozzle row 104A and the nozzle row 104B. Accordingly, uneven density due to landing-position deviation is likely to be noticeable.

Hence, in the present embodiment, the columns 133A of the damper chamber 132A and the columns 133B of the damper chamber 132B corresponding to the nozzle row 104A and the nozzle row 104B, respectively, are arranged in a staggered manner. Such a configuration can separate nozzles 104 subjected to landing-position deviation away from each other and make uneven density less noticeable, thus enhancing the image quality.

In the present embodiment, the distance L11 (illustrated in FIG. 14) between one of the columns 133A of the damper chamber 132A and adjacent one of the columns 133B of the damper chamber 132B in the nozzle array direction NAD is set to 2.5 mm or greater.

Such a configuration can make uneven density less noticeable and secure the damper performance.

In other words, when the recessed portions as the damper chambers 132 are formed in the channel plate 102, the columns 133 are disposed to secure the strength of bonding with the diaphragm member 103. However, the columns 133 may cause uneven density. Hence, in the present embodiment, uneven density is made less noticeable and a sufficient compliance is secured by reducing visual transfer function (VTF) properties due to uneven density.

Figure 15:
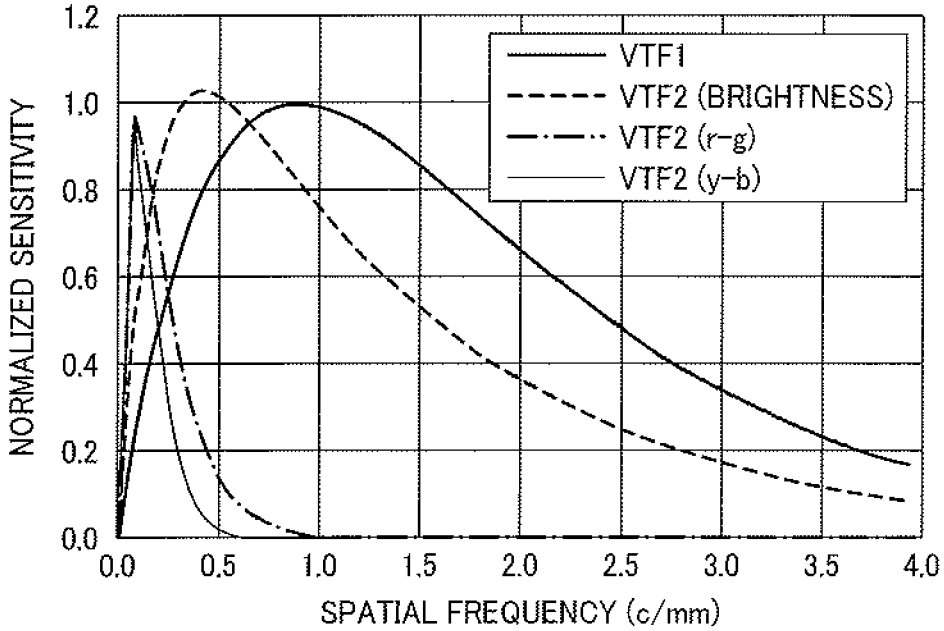
FIG. 15 is a graph of visual transfer function (VTF) properties.

Here, in a VTF property (VTF1) illustrated FIG. 15, the spatial frequency is set to be equal to or greater than 2.5 mm so that the normalized sensitivity is not greater than 0.5. In other words, the columns 133 are set to be repeated at the frequency of 2.5 mm.

From the VTF properties illustrated in FIG. 15, it is found that the properties of uneven density can be reduced by reducing the spatial frequency to 0.2 mm, 0.1 mm, and 0.05 mm. Meanwhile, however, the compliance of the dampers 131 needs to be secured.

Generally, the damper performance is determined by the magnitude of compliance. The compliance C of a damper is determined by the equation: $C=8LW^5/(15\times35\times Et^3)$, where L represents the longitudinal dimension of the damper, W represents the transverse dimension of the damper, E represents Youngs modulus, and t represents the thickness of the damper. When a plurality of (X) dampers is disposed, the compliance C of the dampers can be obtained by the equation: $C=C1+C2+\ldots+CX$.

Accordingly, the compliance C of the damper is based on the first power of the longitudinal dimension L of the damper, the fifth power of the transverse direction W of the damper, and the third power of the thickness of the damper. The factor most affecting the performance of the compliance C is the transverse direction W of the damper.

Hence, an interval corresponding to a longitudinal dimension L of the damper of 2.5 mm or greater is set to meet the compliance C while securing the VTF properties.

Figure 16:
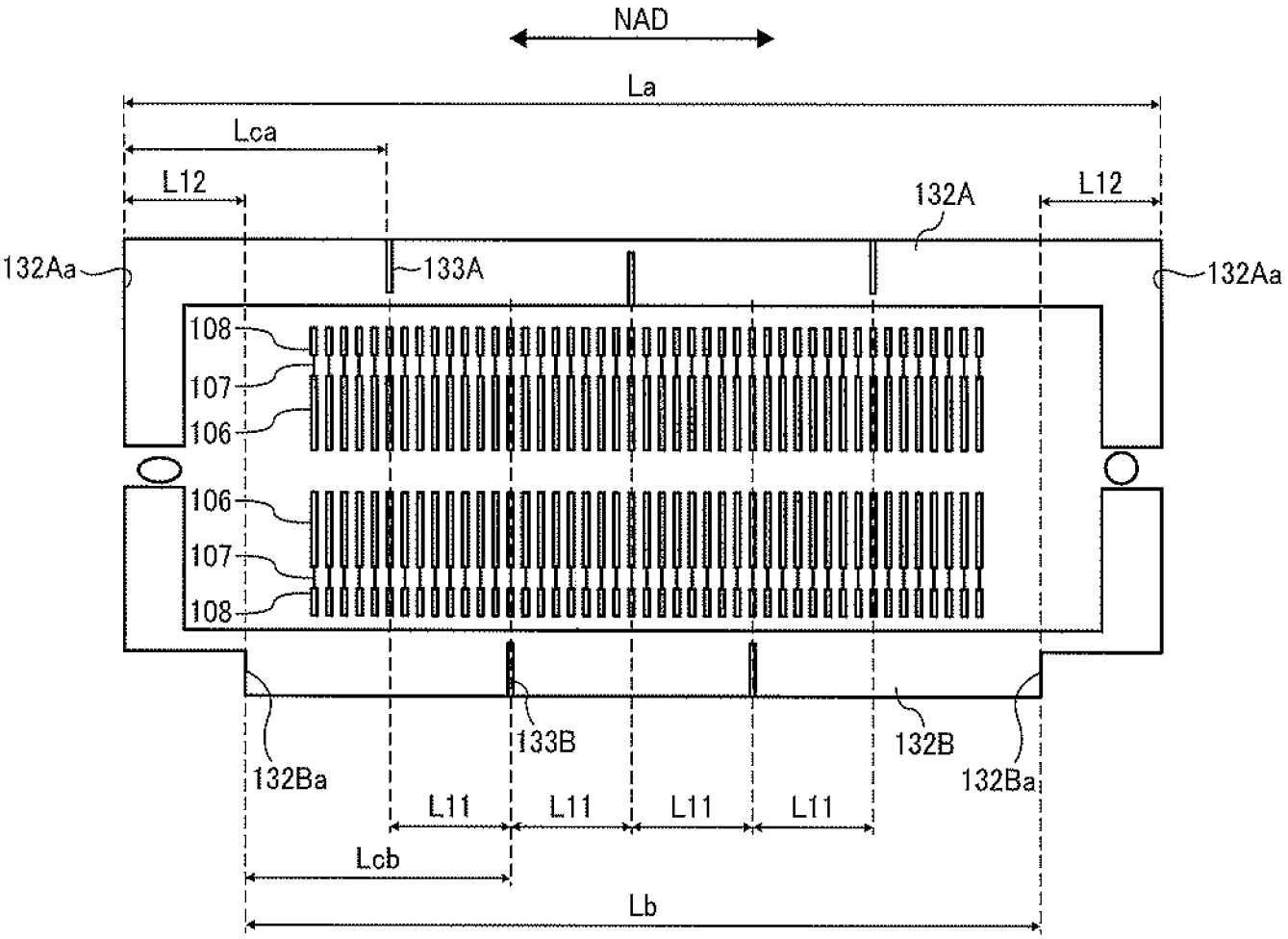
FIG. 16 is a plan view of the damper chambers of the channel plate in a fifth embodiment, seen from the side at which the diaphragm member is disposed.

Next, a fifth embodiment of the present disclosure is described with reference to FIG. 16. FIG. 16 is a plan view of the damper chambers of the channel plate in the fifth embodiment, seen from the side at which the diaphragm member is disposed.

In the present embodiment, end wall faces 132Aa of the damper chamber 132A in the nozzle array direction NAD and end wall faces 132Ba of the damper chamber 132B in the nozzle array direction NAD are disposed at different positions in the nozzle array direction NAD.

In the present embodiment, the distance La between the end wall faces 132Aa of the damper chamber 132A is longer than the distance Lb between the end wall faces 132Ba of the damper chamber 132B. Accordingly, the end wall faces 132Aa of the damper chamber 132A are disposed at different positions from the end wall faces 132Ba of the damper chamber 132B in the nozzle array direction NAD.

In other words, the end wall faces 132Aa of the damper chamber 132A and the end wall faces 132Ba of the damper chamber 132B are fixed ends of the dampers 131.

Accordingly, similarly with the portions at which the columns 133A and the columns 133B are disposed, the decay of pressure wave or influence to absorption performance may arise at the end wall faces 132Aa and the end wall faces 132Ba.

Hence, in the present embodiment, the end wall faces 132Aa of the damper chamber 132A and the end wall faces 132Ba of the damper chamber 132B are disposed at different positions, thus deconcentrating the deviation of the landing positions of droplets.

In such a case, the distance L12 (illustrated in FIG. 16) between the end wall face 132Aa of the damper chamber 132A and the end wall face 132Ba of the damper chamber 132B at each end in the nozzle array direction NAD is preferably not less than 2.5 mm.

In the present embodiment, the distance La between the end wall faces 132Aa of the damper chamber 132A is longer than the distance Lb between the end wall faces 132Ba of the damper chamber 132B. Accordingly, the end wall faces 132Aa of the damper chamber 132A are disposed at different positions from the end wall faces 132Ba of the damper chamber 132B in the nozzle array direction NAD.

With such a configuration, the distance Lea between the column 133A and the end wall face 132Aa at each side in the nozzle array direction NAD can be set to be the same as the distance LCb between the column 133B and the end wall face 132Ba at each side in the nozzle array direction NAD.

Figure 17:
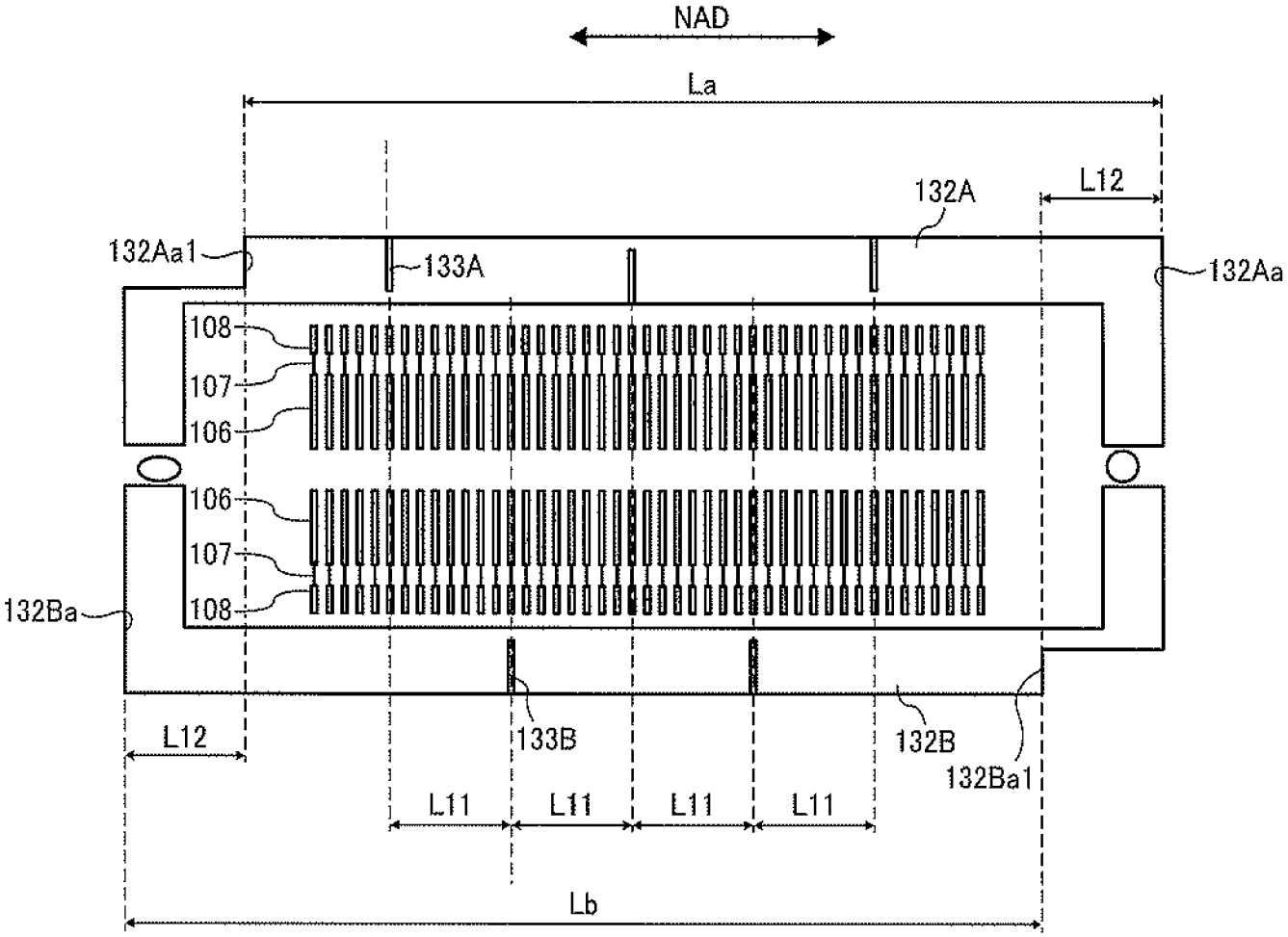
FIG. 17 is a plan view of the damper chambers of the channel plate in a sixth embodiment, seen from the side at which the diaphragm member is disposed.

Next, a sixth embodiment of the present disclosure is described with reference to FIG. 17. FIG. 17 is a plan view of the damper chambers of the channel plate in the sixth embodiment, seen from the side at which the diaphragm member is disposed.

In the present embodiment, the distance La between the end wall face 132Aa and an end wall face 132Aa1 of the damper chamber 132A is the same as the distance Lb between the end wall face 132Ba and an end wall face 132Ba1 of the damper chamber 132B. The end wall face 132Aa1 and the end wall faces 132Ba1, which are at opposite sides in the nozzle array direction NAD, are disposed at an inner side than the end wall face 132Ba and the end wall face 132Aa, respectively, in the nozzle array direction. NAD. Accordingly, the end wall face 132Aa and the end wall face 132Aa1 of the damper chamber 132A are disposed at different positions from the end wall face 132Ba and the end wall face 132Ba1 of the damper chamber 132B in the nozzle array direction NAD.

Such a configuration allows the damper chamber 132A and the damper chamber 132B to have symmetrical shapes.

Note that, in the above-described embodiments, the examples with two nozzle rows are described. However, the above-described embodiments can be applied in a similar manner to configurations with three or more nozzle rows.

Figure 18:
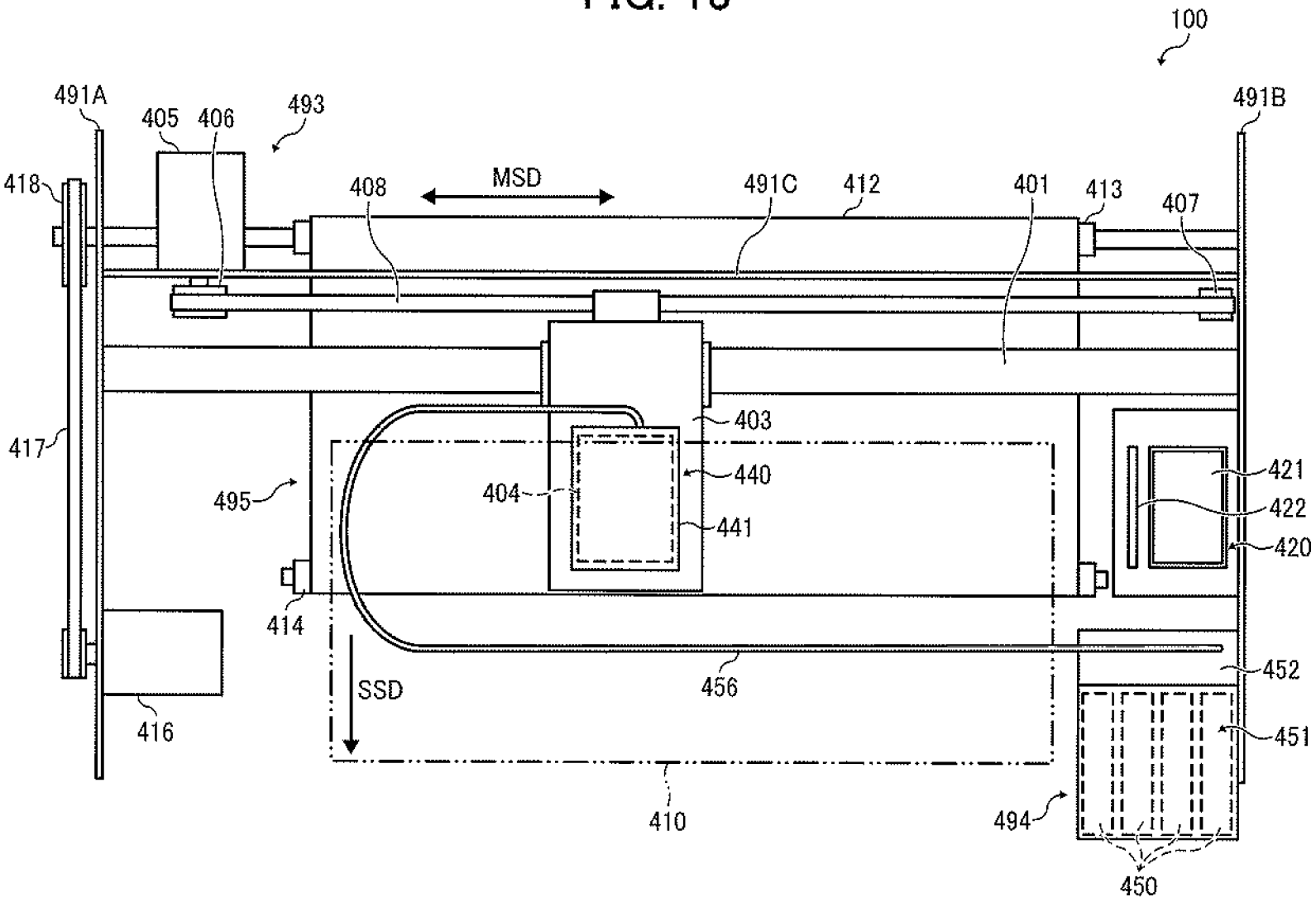
FIG. 18 is a plan view of a portion of a liquid discharge apparatus including a liquid discharge device, according to an embodiment of the present disclosure.
Figure 19:
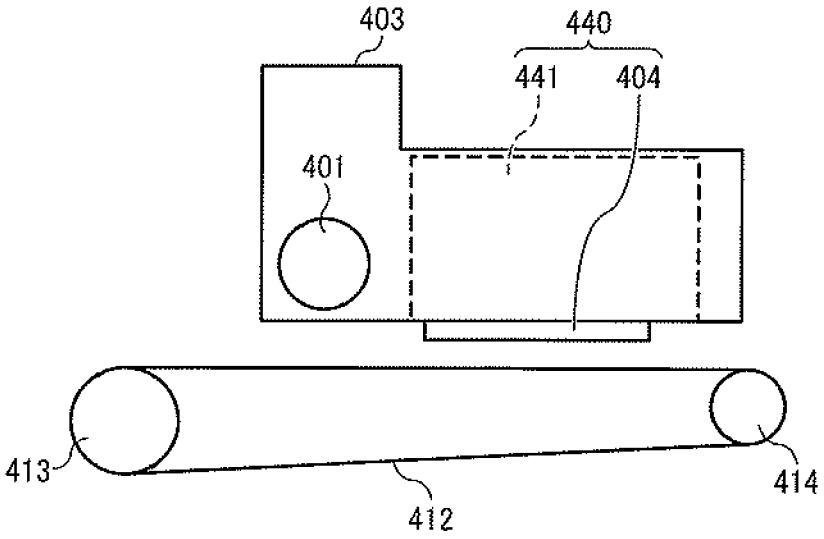
FIG. 19 is a side view of a portion of the liquid discharge apparatus of FIG. 18.

Next, a liquid discharge apparatus according to an embodiment of the present disclosure is described with reference to FIGS. 18 and 19. FIG. 18 is a plan view of a portion of the liquid discharge apparatus according to an embodiment of the present disclosure. FIG. 19 is a side view of a portion of the liquid discharge apparatus of FIG. 18.

A liquid discharge apparatus 100 according to the present embodiment is a serial-type apparatus in which a main scan moving unit 493 reciprocally moves a carriage 403 in a main scanning direction indicated by arrow MSD in FIG. 18. The main scan moving unit 493 includes, e.g., a guide 401, a main scanning motor 405, and a timing belt 408. The guide 401 is laterally bridged between a left side plate 491A and a right side plate 491B and supports the carriage 403 so that the carriage 403 is movable along the guide 401. The main scanning motor 405 reciprocally moves the carriage 403 in the main scanning direction MSD via the timing belt 408 laterally bridged between a drive pulley 406 and a driven pulley 407.

The carriage 403 mounts a liquid discharge device 440 in which the liquid discharge head 404 and a head tank 441 are integrated as a single unit. The liquid discharge head 404 of the liquid discharge device 440 discharges ink droplets of respective colors of yellow (Y), cyan (C), magenta (M), and black (K). The liquid discharge head 404 includes nozzle rows, each including a plurality of nozzles arrayed in row in a sub-scanning direction, which is indicated by arrow SSD in FIG. 18, perpendicular to the main scanning direction MSD. The liquid discharge head 404 is mounted to the carriage 403 so that ink droplets are discharged downward.

The liquid stored outside the liquid discharge head 404 is supplied to the liquid discharge head 404 via a supply unit 494 that supplies the liquid from a liquid cartridge 450 to the head tank 441.

The supply unit 494 includes, e.g., a cartridge holder 451 as a mount part to mount a liquid cartridge 450, a tube 456, and a liquid feed unit 452 including a liquid feed pump. The liquid cartridge 450 is detachably attached to the cartridge holder 451. The liquid is supplied to the head tank 441 by the liquid feed unit 452 via the tube 456 from the liquid cartridge 450.

The liquid discharge apparatus 100 includes a conveyance unit 495 to convey a sheet 410. The conveyance unit 495 includes a conveyance belt 412 as a conveyor and a sub-scanning motor 416 to drive the conveyance belt 412.

The conveyance belt 412 electrostatically attracts the sheet 410 and conveys the sheet 410 at a position facing the liquid discharge head 404. The conveyance belt 412 is an endless belt and is stretched between a conveyance roller 413 and a tension roller 414. The sheet 410 is attracted to the conveyance belt 412 by electrostatic force or air aspiration.

The conveyance roller 413 is driven and rotated by the sub-scanning motor 416 via a timing belt 417 and a timing pulley 418, so that the conveyance belt 412 circulates in the sub-scanning direction SSD.

At one side in the main scanning direction MSD of the carriage 403, a maintenance unit 420 to maintain and recover the liquid discharge head 404 in good condition is disposed on a lateral side of the conveyance belt 412.

The maintenance unit 420 includes, for example, a cap 421 to cap a nozzle face (i.e., a face on which the nozzles are formed) of the liquid discharge head 404 and a wiper 422 to wipe the nozzle face.

The main scan moving unit 493, the supply unit 494, the maintenance unit 420, and the conveyance unit 495 are mounted to a housing that includes the left side plate 491A, the right side plate 491B, and a rear side plate 491C.

In the liquid discharge apparatus 100 thus configured, a sheet 410 is conveyed on and attracted to the conveyance belt 412 and is conveyed in the sub-scanning direction SSD by the cyclic rotation of the conveyance belt 412.

The liquid discharge head 404 is driven in response to image signals while the carriage 403 moves in the main scanning direction MSD, to discharge liquid to the sheet 410 stopped, thus forming an image on the sheet 410.

As described above, the liquid discharge apparatus 100 includes the liquid discharge head 404 according to an embodiment of the present disclosure, thus allowing stable formation of high quality images.

Figure 20:
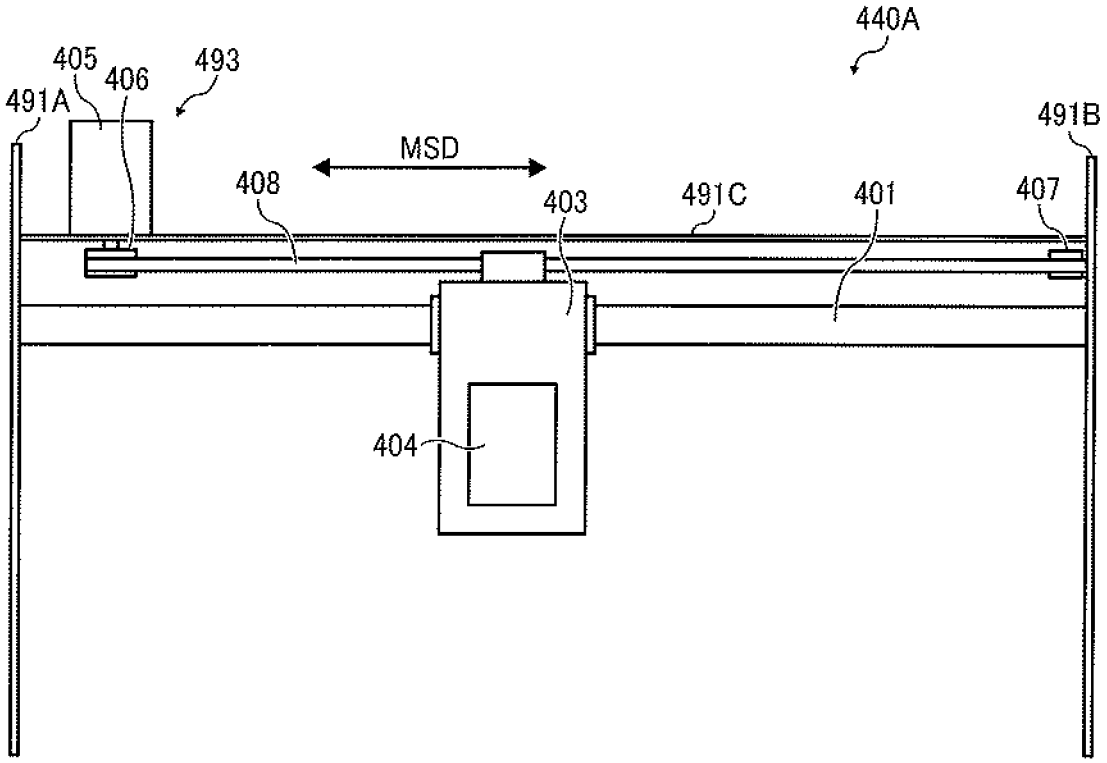
FIG. 20 is a plan view of a portion of another example of the liquid discharge device.

Next, another example of the liquid discharge device according to an embodiment of the present disclosure is described with reference to FIG. 20. FIG. 20 is a plan view of a portion of another example of the liquid discharge device (liquid discharge device 440A).

The liquid discharge device 440A includes the housing, the main scan moving unit 493, the carriage 403, and the liquid discharge head 404 among components of the liquid discharge apparatus 100. The left side plate 491A, the right side plate 491B, and the rear side plate 491C form the housing.

Note that, in the liquid discharge device 440A, at least one of the maintenance unit 420 and the supply unit 494 may be mounted on, for example, the right side plate 491B.

Figure 21:
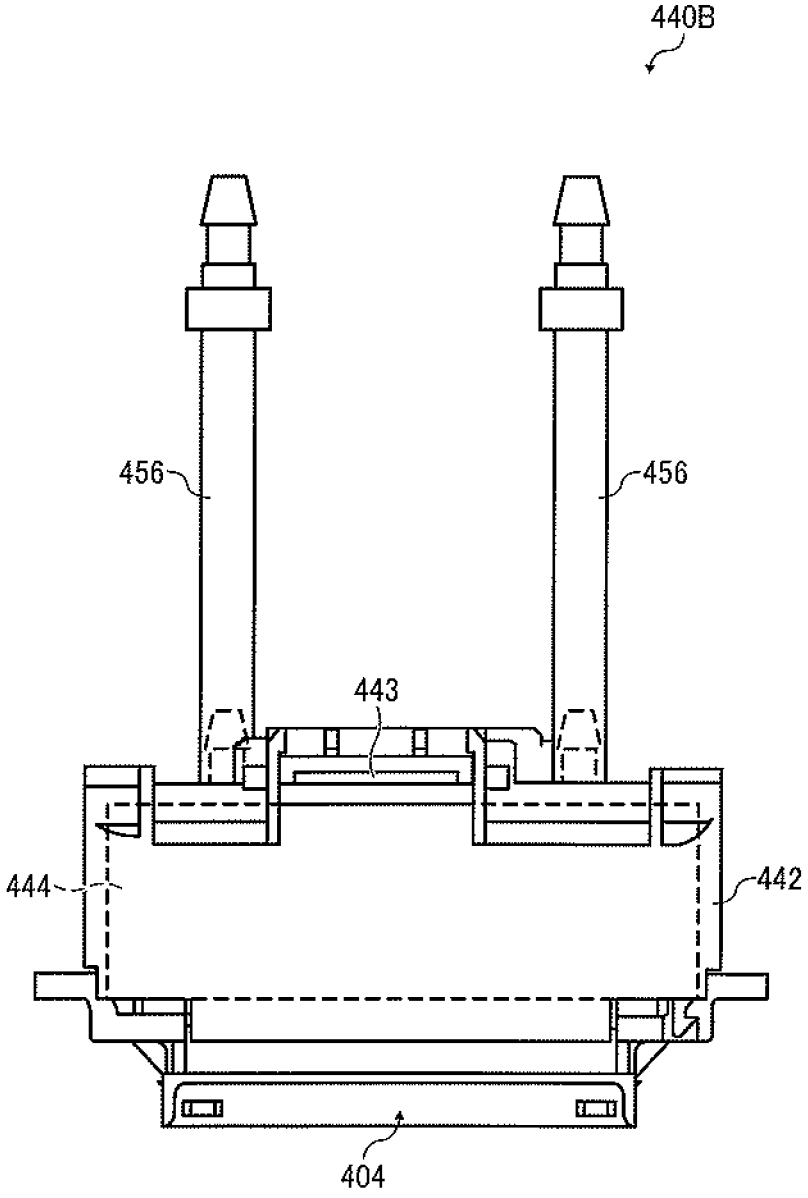
FIG. 21 is a front view of still another example of the liquid discharge device.

Next, still another example of the liquid discharge device according to an embodiment of the present disclosure is described with reference to FIG. 21. FIG. 21 is a front view of still another example of the liquid discharge device (liquid discharge device 440B).

The liquid discharge device 440B includes the liquid discharge head 404 to which a channel part 444 is mounted, and the tube 456 connected to the channel part 444.

Further, the channel part 444 is disposed inside a cover 442. Instead of the channel part 444, the liquid discharge device 440B may include the head tank 441. A connector 443 to electrically connect the liquid discharge head 404 to a power source is disposed above the channel part 444.

Figure 22:
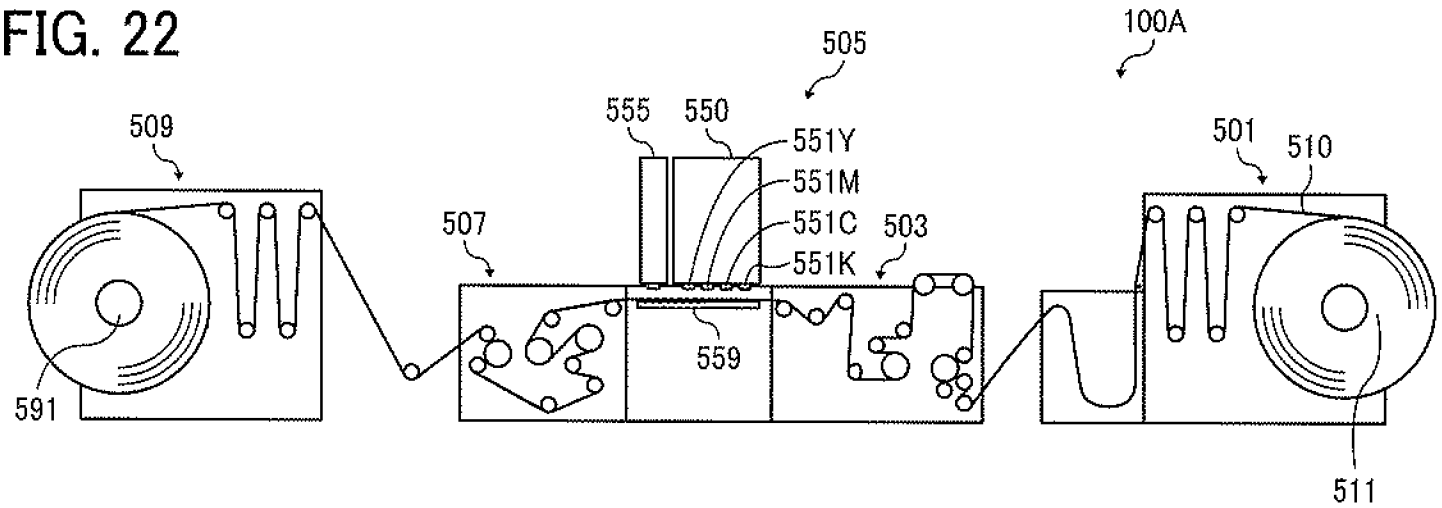
FIG. 22 is a side view of another example of the liquid discharge apparatus.
Figure 23:
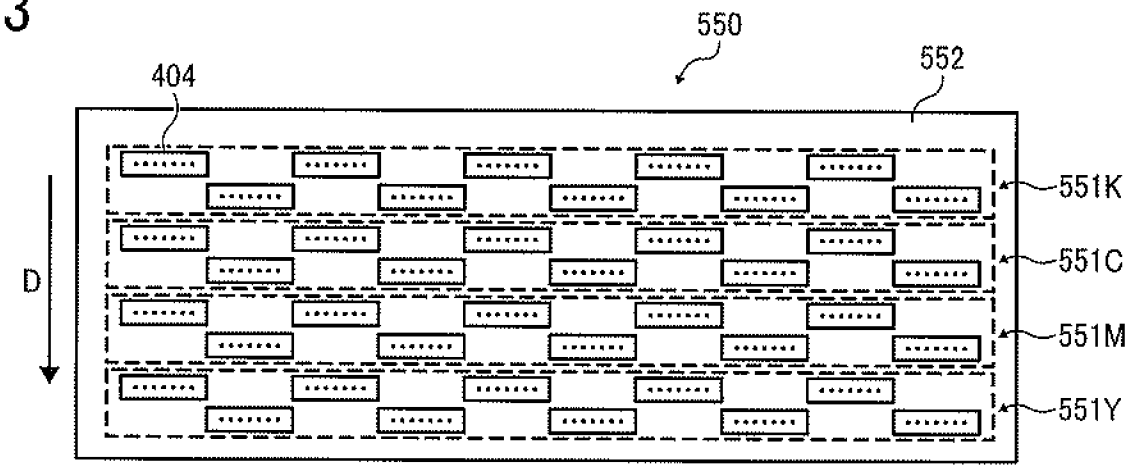
FIG. 23 is a plan view of a head unit of the liquid discharge apparatus of FIG. 22.

Next, another example of the liquid discharge apparatus according to an embodiment of the present disclosure is described with reference to FIGS. 22 and 23. FIG. 22 is an illustration of the liquid discharge apparatus according to an embodiment of the present disclosure. FIG. 23 is a plan view of a head unit of the liquid discharge apparatus.

The liquid discharge apparatus 100A according to the present embodiment includes a feeder 501 to feed a continuous medium 510, a guide conveyor 503 to guide and convey the continuous medium 510, fed from the feeder 501, to a printing unit 505, the printing unit 505 to discharge liquid onto the continuous medium 510 to form an image on the continuous medium 510, a drier unit 507 to dry the continuous medium 510, and an ejector 509 to eject the continuous medium 510.

The continuous medium 510 is fed from a root winding roller 511 of the feeder 501, guided and conveyed with rollers of the feeder 501, the guide conveyor 503, the drier unit 507, and the ejector 509, and wound around a winding roller 591 of the ejector 509.

In the printing unit 505, the continuous medium 510 is conveyed opposite a first head unit 550 and a second head unit 555 on a conveyance guide 559. The first head unit 550 discharges liquid to form an image on the continuous medium 510. Post-treatment is performed on the continuous medium 510 with treatment liquid discharged from the second head unit 555.

Here, the first head unit 550 includes, for example, four-color full-line head arrays 551K, 551C, 551M, and 551Y (hereinafter, collectively referred to as "head arrays 551" unless colors are distinguished) from an upstream side in a feed direction of the continuous medium 510 (hereinafter, "medium feed direction") indicated by arrow D in FIG. 23.

The head arrays 551K, 551C, 551M, and 551Y are liquid dischargers to discharge liquid of black (K), cyan (C), magenta (M), and yellow (Y) onto the continuous medium 510. Note that the number and types of color are not limited to the above-described four colors of K, C, M, and Y and may be any other suitable number and types.

In each head array 551, for example, as illustrated in FIG. 23, a plurality of liquid discharge heads (also referred to as simply "heads") 404 are arranged in a staggered manner on a base 552 to form the head array. Note that the configuration of the head array 551 is not limited to such a configuration. In the present embodiment, each head array 551 is formed with the liquid discharge heads 404 and the head tanks to supply liquid to the liquid discharge heads 404. However, the configuration of the head array is not limited to such a configuration. In some embodiments, the configuration with the liquid discharge heads alone may be employed.

In the present disclosure, discharged liquid is not limited to a particular liquid as long as the liquid has a viscosity or surface tension to be discharged from a head. However, preferably, the viscosity of the liquid is not greater than 30 mPa·s under ordinary temperature and ordinary pressure or by heating or cooling. Examples of the liquid include a solution, a suspension, or an emulsion including, for example, a solvent, such as water or an organic solvent, a colorant, such as dye or pigment, a functional material, such as a polymerizable compound, a resin, a surfactant, a biocompatible material, such as DNA, amino acid, protein, or calcium, and an edible material, such as a natural colorant. Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Examples of an energy source for generating energy to discharge liquid include a piezoelectric actuator (a laminated piezoelectric element or a thin-film piezoelectric element), a thermal actuator that employs a thermoelectric conversion element, such as a thermal resistor, and an electrostatic actuator including a diaphragm and opposed electrodes.

The liquid discharge device is an integrated unit including the liquid discharge head and a functional part(s) or unit(s), and is an assembly of parts relating to liquid discharge. For example, the liquid discharge device may be a combination of the liquid discharge head with at least one of the head tank, the carriage, the supply unit, the maintenance unit, and the main scan moving unit.

Here, the integrated unit may also be a combination in which the liquid discharge head and a functional part(s) are secured to each other through, e.g., fastening, bonding, or engaging, or a combination in which one of the liquid discharge head and a functional part(s) is movably held by another. The liquid discharge head may be detachably attached to the functional part(s) or unit(s) s each other.

For example, the liquid discharge head and a head tank are integrated as the liquid discharge device. The liquid discharge head and the head tank may be connected each other via, e.g., a tube to integrally form the liquid discharge device. Here, a unit including a filter may further be added to a portion between the head tank and the liquid discharge head.

In another example, the liquid discharge device may be an integrated unit in which a liquid discharge head is integrated with a carriage.

In still another example, the liquid discharge device may be the liquid discharge head movably held by a guide that forms part of a main-scanning moving device, so that the liquid discharge head and the main-scanning moving device are integrated as a single unit. The liquid discharge device may include the liquid discharge head, the carriage, and the main scan moving unit that are integrated as a single unit.

In another example, the cap that forms part of the maintenance unit is secured to the carriage mounting the liquid discharge head so that the liquid discharge head, the carriage, and the maintenance unit are integrated as a single unit to form the liquid discharge device.

Further, in another example, the liquid discharge device includes tubes connected to the head tank or the channel member mounted on the liquid discharge head so that the liquid discharge head and the supply assembly are integrated as a single unit. Liquid is supplied from a liquid reservoir source to the liquid discharge head.

The main-scan moving unit may be a guide only. The supply unit may be a tube(s) only or a loading unit only.

The term "liquid discharge apparatus" used herein also represents an apparatus including the liquid discharge head or the liquid discharge device to discharge liquid by driving the liquid discharge head. The liquid discharge apparatus may be, for example, an apparatus capable of discharging liquid to a material to which liquid can adhere or an apparatus to discharge liquid toward gas or into liquid.

The liquid discharge apparatus may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The liquid discharge apparatus may be, for example, an image forming apparatus to form an image on a sheet by discharging ink, or a three-dimensional apparatus to discharge a molding liquid to a powder layer in which powder material is formed in layers, so as to form a three-dimensional article.

The liquid discharge apparatus is not limited to an apparatus to discharge liquid to visualize meaningful images, such as letters or figures. For example, the liquid discharge apparatus may be an apparatus to form meaningless images, such as meaningless patterns, or fabricate three-dimensional images.

The above-described term "material on which liquid can be adhered" represents a material on which liquid is at least temporarily adhered, a material on which liquid is adhered and fixed, or a material into which liquid is adhered to permeate. Examples of the "material on which liquid can be adhered" include recording media, such as paper sheet, recording paper, recording sheet of paper, film, and cloth, electronic component, such as electronic substrate and piezoelectric element, and media, such as powder layer, organ model, and testing cell. The "material on which liquid can be adhered" includes any material on which liquid is adhered, unless particularly limited.

Examples of the material on which liquid can be adhered include any materials on which liquid can be adhered even temporarily, such as paper, thread, fiber, fabric, leather, metal, plastic, glass, wood, and ceramic.

The liquid discharge apparatus may be an apparatus to relatively move a liquid discharge head and a material on which liquid can be adhered. However, the liquid discharge apparatus is not limited to such an apparatus. For example, the liquid discharge apparatus may be a serial head apparatus that moves the liquid discharge head or a line head apparatus that does not move the liquid discharge head.

Examples of the liquid discharge apparatus further include a treatment liquid coating apparatus to discharge a treatment liquid to a sheet to coat the treatment liquid on the surface of the sheet to reform the sheet surface and an injection granulation apparatus in which a composition liquid including raw materials dispersed in a solution is injected through nozzles to granulate fine particles of the raw materials.

The terms "image formation", "recording", "printing", "image printing", and "molding" used herein may be used synonymously with each other.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge head, comprising:

a plurality of nozzle rows each of which includes a plurality of nozzles configured to discharge liquid and arrayed in a nozzle array direction;

a plurality of individual liquid chambers communicated with the respective nozzles of a corresponding nozzle row amongst the nozzle rows;

a plurality of common liquid chambers corresponding to the respective nozzle rows, to supply, by each common liquid chamber, liquid to the corresponding plurality of individual liquid chambers;

a plurality of dampers corresponding to the respective nozzle rows, each damper constituting a wall face of a corresponding common liquid chamber amongst the common liquid chambers and arranged longitudinally along the nozzle array direction; and a plurality of damper chambers corresponding to the respective nozzle rows, each damper chamber being disposed with a corresponding damper interposed between the damper chamber and a corresponding common liquid chamber, wherein each of the damper chambers includes a plurality of columns to support the corresponding damper, and wherein each of the plurality of columns in a first damper chamber is arranged at a mutually different location in the nozzle array direction from each of the plurality of columns in a second damper chamber, amongst the plurality of damper chambers.

2. The liquid discharge head according to claim 1, wherein the columns in the first damper chamber and the columns in the second damper chamber are alternately disposed in a staggered manner in the nozzle array direction.

3. The liquid discharge head of claim 2, wherein the columns in the first damper chamber and the columns in the second damper chamber are alternately disposed in the staggered manner so that alternate columns are equally spaced apart from each other in the nozzle array direction.

4. The liquid discharge head according to claim 1, wherein a distance between one of the columns in the first damper chamber and an adjacent one of the columns in the second damper chamber adjacent to the one of the columns in the first damper chamber in the nozzle array direction is equal to or greater than 2.5 mm in the nozzle array direction.

5. The liquid discharge head according to claim 1, wherein an end wall face of the first damper chamber and an end wall face of the second damper chamber in the nozzle array direction are disposed at different positions in the nozzle array direction.

6. A liquid discharge device comprising the liquid discharge head according to claim 1, to discharge the liquid.

7. The liquid discharge device according to claim 6, wherein the liquid discharge head is integrated as a single unit with at least one of:

a head tank to store the liquid to be supplied to the liquid discharge head;

a carriage mounting the liquid discharge head;

a supply unit to supply the liquid to the liquid discharge head;

a maintenance unit to maintain and recover the liquid discharge head; and a main scan moving unit to move the liquid discharge head in a main scanning direction.

8. A liquid discharge apparatus comprising the liquid discharge device according to claim 6 to discharge the liquid.

9. A liquid discharge apparatus comprising the liquid discharge head according to claim 1 to discharge the liquid.

10. The liquid discharge head of claim 1, wherein each of the plurality of columns of each of the plurality of damper chambers is arranged at a mutually different location in the nozzle array direction.

* * * * *